US012728318B2

(12) United States Patent
Chen

(10) Patent No.: US 12,728,318 B2
(45) Date of Patent: Sep. 8, 2026

(54) FIN AND FIN BLADE

(71) Applicant: SUNNY INDUSTRIAL ENGINEERING CO., LTD, Tuo Yuan City (TW)

(72) Inventor: I Wen Chen, Tuo Yuan City (TW)

(73) Assignee: SUNNY INDUSTRIAL ENGINEERING CO., LTD, Tuo Yuan City (TW)

( * ) Notice: Subject to any disclaimer, the term of this patent is extended or adjusted under 35 U.S.C. 154(b) by 734 days.

(21) Appl. No.: 17/996,375

(22) PCT Filed: Apr. 19, 2021

(86) PCT No.: PCT/AU2021/050345

§ 371 (c)(1),
(2) Date: Oct. 17, 2022

(87) PCT Pub. No.: WO2021/207800

PCT Pub. Date: Oct. 21, 2021

(65) Prior Publication Data

US 2023/0191201 A1 Jun. 22, 2023

(30) Foreign Application Priority Data

Apr. 17, 2020 (AU) ..... 2020901227

(51) Int. Cl.
*A63B 31/11* (2006.01)

(52) U.S. Cl.
CPC ..... *A63B 31/11* (2013.01); *A63B 2031/115* (2013.01); *A63B 2209/023* (2013.01)

(58) Field of Classification Search
CPC ..... A63B 31/11; A63B 2031/112; A63B 2031/115; A63B 2209/02;
(Continued)

(56) References Cited

U.S. PATENT DOCUMENTS 4,521,220 A 6/1985 Schoofs
6,126,502 A * 10/2000 Hull ..... A63B 31/11 441/63

(Continued)

FOREIGN PATENT DOCUMENTS

FR 2389386 A1 12/1978
GB 2472981 A 3/2011
WO 9409860 A1 5/1994

OTHER PUBLICATIONS

International Search Report for International Application No. PCT/AU2021/050345 mailed Oct. 21, 2021.

(Continued)

*Primary Examiner* — Daniel V Venne
(74) *Attorney, Agent, or Firm* — Perilla Knox & Hildebrandt; Kenneth A. Knox

(57) ABSTRACT

A fin blade for free diving or swimming or scuba diving is described, which has a cross section at one end angled about a yaw, or longitudinal, axis relative to the cross section at the other end. The arrangement is such that a lateral line at a proximal end is disposed at an angle relative to a lateral line at a portion spaced from the proximal end. The fin blade is more closely aligned with the ergonomic complexities of the human body, such that during finning the fin blade provides greater comfort and/or propulsion. A fin blade is also described which includes a reinforced zone in one portion of the fin blade, such that one portion of the blade at the distal end is relatively increased in flexibility to provide a catch zone at one portion of the distal end of the fin blade.

11 Claims, 12 Drawing Sheets

(58) Field of Classification Search
CPC . A63B 2209/023; A63B 69/12; A63B 69/125; A63B 2244/20
USPC ..... 441/55, 60, 61, 64
See application file for complete search history.

(56) References Cited

U.S. PATENT DOCUMENTS

| | | | |
|---|---|---|---|
| 7,223,141 | B1 | 5/2007 | Shiue |
| 2001/0044246 | A1 | 11/2001 | McCarthy |

OTHER PUBLICATIONS

Written Opinion for International Application No. PCT/AU2021/050345 mailed Oct. 21, 2021.
Zvaritch, K, "Freediving Fins—The Easy Guide To Choosing The Best Fins For You," Deeper Blue, Alleged Publication: May 23, 2018, [retrieved on Oct. 16, 2022] <URL: https://www.deeperblue.com/a-guide-to-choosing-your-freediving-fins/> <Redirected URL: https://www.deeperblue.com/freediving-fins-easy-guide/>.
Kennedy, K, Best Freediving Fins 2020, Idiveblue, Published Oct. 23, 2022, [retrieved from internet on Oct. 16, 2022] <URL: https://web.archive.org/web/20201023023137/https://www.idiveblue.com/best-freediving-fins/>.
Extended European Search Report for EP Patent Application No. 21788081.4 of Jul. 3, 2024.
Office Action for KR Patent Application No. 10-2022-7040293 of Nov. 21, 2025.

* cited by examiner

FIN AND FIN BLADE

CROSS-REFERENCE TO RELATED APPLICATIONS

This application is a national phase application under 35 U.S.C. § 371 of PCT/AU2021/050345 filed Apr. 19, 2021 entitled "A NEW FIN AND FIN BLADE," which claims the benefit of and priority to Australian Patent Application No. 2020901227 filed Apr. 17, 2020, the contents of both of which being incorporated by reference in their entireties herein.

TECHNICAL FIELD

The present technology relates generally to diving fins, including scuba diving fins, free diving fin assemblies, scuba diving fin assemblies, scuba diving fin blades and free diving fin blades.

BACKGROUND

Diving is very popular. The sense of peace and freedom to be found when underwater is highly rated among participants. The present technology finds efficient application in any form of diving. The remainder of the specification, however, will discuss free diving. Free diving in particular, is an underwater multi-discipline sport that is characterized by breath-holding diving; while free diving, divers do not use scuba equipment to provide air while underwater. Free diving includes spearfishing, underwater hockey, underwater rugby, snorkeling, apnea and competitive apnea.

Competitive apnea takes a myriad of forms: Constant weight apnea, dynamic apnea, jump blue, variable weight apnea. In these competitions, divers look for maximum efficiency from their fins.

There is a myriad array of fins available. Basically there are those of unified construction, in which all components may be glued together or molded together as one unit, and those of multi-part construction, in which the fin may be readily disassembled into its component parts by use of a screwdriver or Allen key or like tool. Disassembly may even be tool-less.

Component parts of fins include foot pocket and blades. In the multi-part fin designs, the blades are detachable from, or at least insertable into, the fin pocket. The blades fit into the foot pocket by insertion of a tongue, and the tongue is held in the foot pocket by fastening screws, or even glue. The tongue can be angled, usually downwards, to provide certain advantages of finning efficiency, perhaps when a diver is on the surface, and even to provide a particular ergonomic advantage when finning horizontally or vertically.

The present technology seeks to ameliorate one or more of the above mentioned disadvantages, and/or to provide a finning efficiency improvement over known fins and fin blades, by seeking to provide a closer alignment of the fin to the mechanics of a diver's body.

SUMMARY

Broadly, the present technology provides a free diving fin blade which is angled and/or twisted about a yaw, or longitudinal, axis.

Broadly, the present technology provides a free diving fin which includes a blade angled and/or twisted about a yaw, or longitudinal, axis.

Advantageously, it is believed that the present technology provides a free diving fin which is more closely aligned with the ergonomic complexities of the human body than known fins, such that during finning (the diving term for kicking along, up or down, with the legs while wearing fins on the feet) the blade provides greater comfort and/or propulsion than known fins.

In accordance with one aspect of the present disclosure there is provided a free diving fin blade including a main portion twisted from one end to the other about a yaw, or longitudinal, axis.

In accordance with another aspect of the present disclosure there is provided a free diving fin blade where the fin blade cross section at one end is disposed at an angle relative to the cross section at the other end.

In accordance with yet another aspect of the present disclosure there is provided a free diving fin blade wherein a lateral line at a proximal end is disposed at an angle relative to a lateral line at a portion spaced from the proximal end.

In accordance with still another aspect of the present disclosure there is provided a free diving fin blade wherein a line from rail to rail at one end is disposed at an angle relative to a line from rail to rail at the other end.

In accordance with a yet further aspect of the present disclosure there is provided a free diving fin which includes a blade which is twisted about a longitudinal or yaw axis.

In one embodiment the blade includes a tongue for connecting a main blade portion to a foot pocket.

In one embodiment the main blade portion is angled downwardly relative to the tongue to facilitate comfort when finning on the water surface and for ergonomic comfort generally underwater, finning up, down or along.

In one embodiment the tongue is angled downwardly, (about a roll axis or substantially lateral line) relative to the main blade portion for increased comfort and efficiency when finning.

In one embodiment the main blade portion is angled relative to the tongue downwardly by between 1 and 45 degrees.

In one embodiment the main blade portion is angled relative to the tongue downwardly by between 2 and 20 degrees.

In one embodiment the main blade portion is angled relative to the tongue downwardly by between 2 and 22 degrees.

In one embodiment the main blade portion is angled relative to the tongue downwardly by between 2 and 23 degrees.

In one embodiment the main blade portion is angled relative to the tongue downwardly by between 2 and 26 degrees.

In one embodiment the main blade portion is angled relative to the tongue downwardly by between 3 and 30 degrees.

In one embodiment the main blade portion is angled relative to the tongue downwardly by between 3 and 33 degrees.

In one embodiment the main blade portion is angled relative to the tongue downwardly by between 3 and 35 degrees.

In one embodiment the main blade portion is angled relative to the tongue downwardly by between 2 and 30 degrees.

In one embodiment the main blade portion is angled relative to the tongue downwardly by between 2 and 10 degrees.

In one embodiment the main blade portion is angled relative to the tongue downwardly by between 2 and 5 degrees.

In one embodiment the main blade portion is angled relative to the tongue downwardly by about 2.25 degrees.

In one embodiment the lateral line at the proximal end is elevated from one side to the other by between 1 and 50 mm.

In one embodiment the lateral line at the proximal end is elevated from one side to the other by between 2 and 20 mm.

In one embodiment the lateral line at the proximal end is elevated from one side to the other by between 5 and 10 mm.

In one embodiment the lateral line at the proximal end is elevated from one side to the other by between 2 and 35 mm.

In one embodiment the lateral line at the proximal end is elevated from one side to the other by between 3 and 15 mm.

In one embodiment the lateral line at the proximal end is elevated from one side to the other by between 5 and 10 mm.

In one embodiment the lateral line at the proximal end is elevated from one side to the other by about 5 mm.

In one embodiment the lateral line at the proximal end is elevated from one side to the other by about 4 mm.

In one embodiment the lateral line at the proximal end is elevated from one side to the other by about 3 mm.

In one embodiment the lateral line at the proximal end is elevated from one side to the other by about 10 mm.

In one embodiment the main blade portion is substantially planar in shape.

In one embodiment the main blade portion includes rails to inhibit vortices forming, or simply to channel water along the blade more effectively for greater efficiency of finning. The rails also facilitate increased stiffness of the main blade portion.

In one embodiment the blade twist commences at a lateral joint between the tongue and the main blade portion.

In one embodiment the blade twist is twisted inwards to suit certain divers' ergonomic mechanics.

In one embodiment the blade twist is twisted outwards to suit certain divers' ergonomic mechanics.

In one embodiment the lateral line between the tongue and the main blade portion is disposed at an angle about an axis normal to the main blade surface.

In one embodiment the angle of the lateral line is between about 5 and 45 degrees.

In one embodiment the angle of the lateral line is 2.25 degrees.

In one embodiment the angle of the lateral line is 1.5 degrees.

In one embodiment the angle of the lateral line is 2.5 degrees.

In one embodiment the angle of the lateral line is 3 degrees.

In one embodiment the angle of the lateral line is 4 degrees.

In one embodiment the angle of the lateral line is 5 degrees.

In one embodiment the angle of the lateral line is 6 degrees.

In one embodiment the angle of the lateral line is 7 degrees.

In one embodiment the angle of the lateral line is 8 degrees.

In one embodiment the angle of the lateral line is 9 degrees.

In one embodiment there is a radius on the lateral edges of the blade to reduce stresses. In one embodiment the radius is about 50 mm.

In one embodiment the tail end of the main blade portion is a fish tail shape.

In one embodiment the tail end of the main blade portion is a jet tail shape.

In one embodiment the tail end of the main blade portion is a swallowtail shape.

In one embodiment the tail end of the main blade portion is rounded.

In accordance with another aspect of the present disclosure there is provided a fin blade for free diving which includes a flexible matrix, and a reinforced zone disposed on the flexible matrix in a region proximal a foot pocket and adjacent at least a portion of an edge of the proximal region.

In an embodiment the reinforced zone is disposed adjacent at least a portion of an outer edge of the proximal region.

In an embodiment the reinforced zone is disposed adjacent at least a portion of an inner edge of the proximal region.

In an embodiment the main blade portion includes a flexible matrix, and a reinforced zone disposed on the flexible matrix in a region proximal both a foot pocket and extending along at least a portion of an outer rail.

In an embodiment the main blade portion includes a flexible matrix, and a reinforced zone disposed on the flexible matrix in a region proximal both a foot pocket and extending along at least a portion of an inner rail In an embodiment the reinforced zone is disposed in a substantially triangular region at a proximal end near a foot pocket, bounded by a line from an inner end of a proximal region to an intermediate point along an outer edge of the main blade portion.

In an embodiment the reinforced zone is disposed in a substantially triangular region at a proximal end near a foot pocket, bounded by a line from an outer end of a proximal region to an intermediate point along an inner edge of the main blade portion.

In an embodiment the substantially triangular region of the reinforced zone includes curved edges.

In an embodiment there is provided a flexible catch zone, adjacent the reinforced zone, which is generally comprised of only the flexible matrix.

In some embodiments the reinforced zone includes a layup of about an additional 200 g balance strength carbon fiber matting to provide the reduced flex in the outer zone along the outer edge and proximal the location of the outer toes would be in the fin assembly when fitted to a user.

In some embodiments the reinforced zone includes a layup of about an additional 200 g balance strength carbon fiber matting to provide the reduced flex in the inner zone along the inner edge and proximal the location of the inner toes would be in the fin assembly when fitted to a user.

Clarifications

In this specification, where a document, act or item of knowledge is referred to or discussed, this reference or discussion is not an admission that the document, act or item of knowledge or any combination thereof was at the priority date:

(a) part of common general knowledge; or (b) known to be relevant to an attempt to solve any problem with which this specification is concerned.

It is to be noted that, throughout the description and claims of this specification, the word 'comprise' and variations of the word, such as 'comprising' and 'comprises', is not intended to exclude other variants or additional components, integers or steps.

BRIEF DESCRIPTION OF THE DRAWINGS

In order to enable a clearer understanding, an embodiment of the technology will now be further explained and illustrated by reference to the accompanying drawings, in which:

FIG. 6*a* is a shorter fin blade, about 500 mm long, and FIG. 6*b* is a longer blade, about 635 mm long;

DETAILED DESCRIPTION

Figure 1:
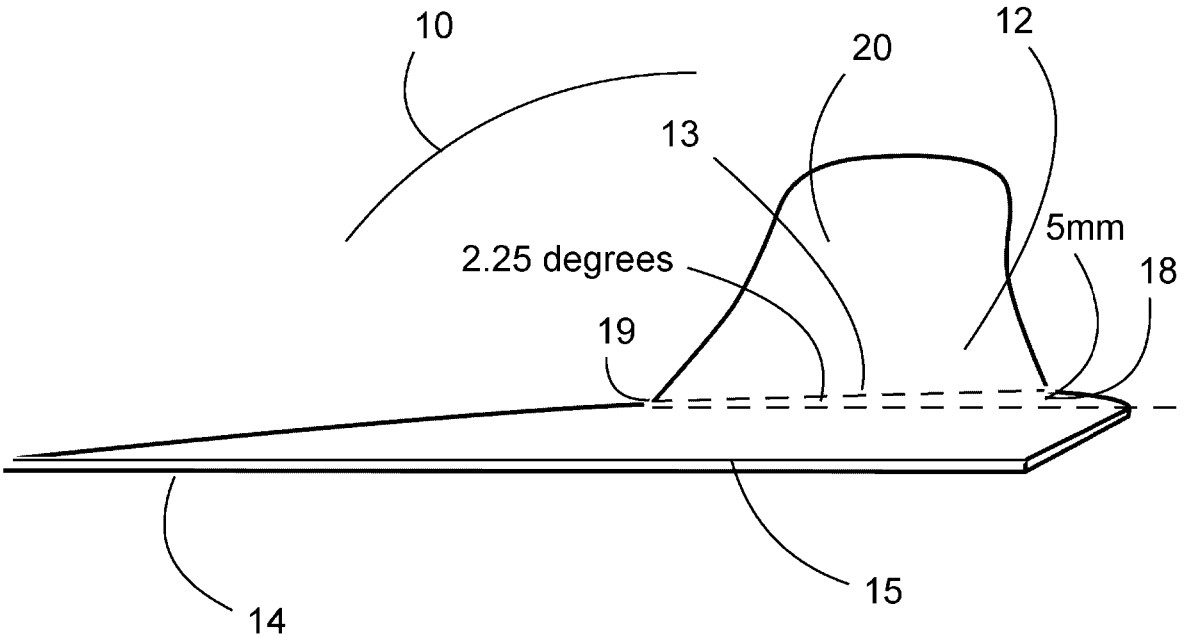
FIG. 1 is a tail or distal end elevation view of a prototype fin blade with lateral construction lines showing the twist in the blade.
Figure 2:
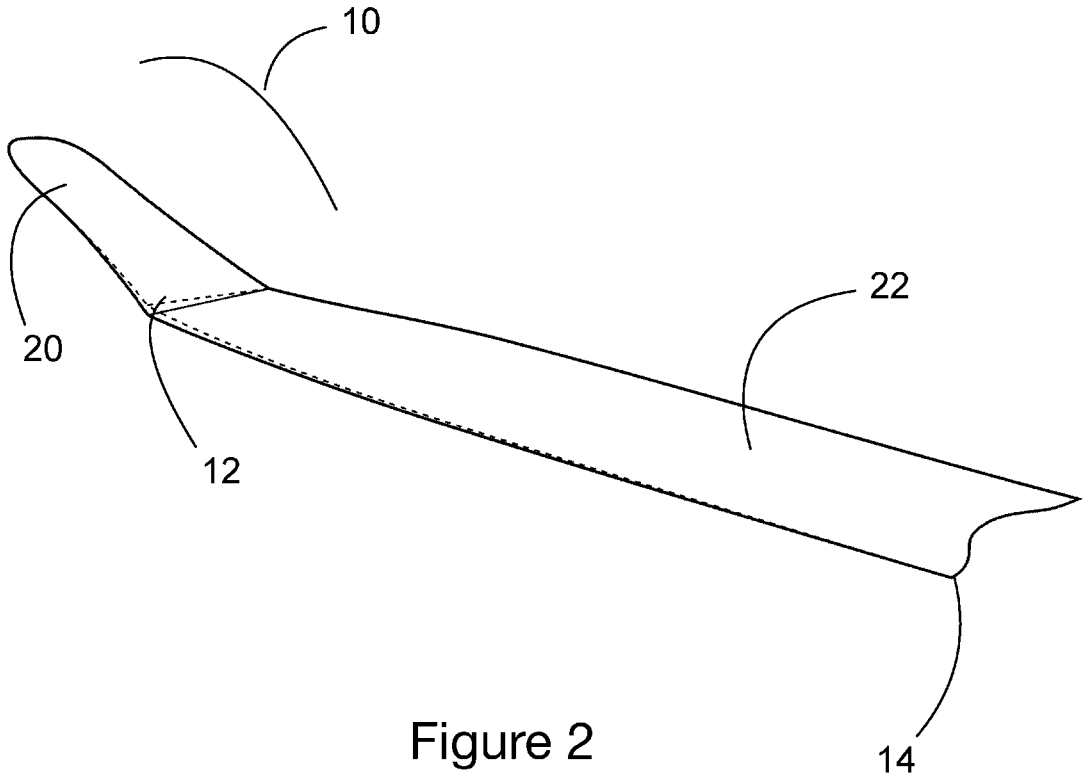
FIG. 2 is an isometric view from underneath and the distal or tail end of two free diving fin blades, one closest to the viewer being the fin blade of an embodiment of the present technology, having twist about a longitudinal or yaw axis, and the fin blade underneath with its edges only shown, being a known embodiment with no blade twist.
Figure 3:
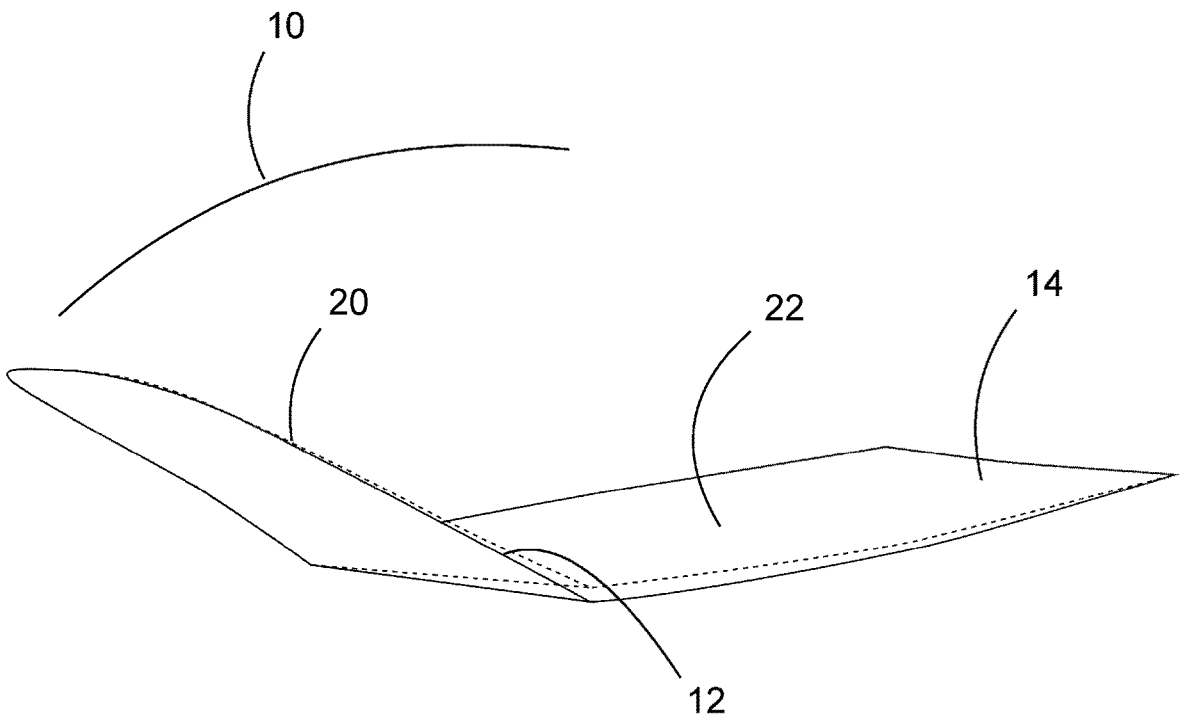
FIG. 3 is an isometric view from the proximal or tongue end of the two fins shown in FIG. 2.
Figure 4:
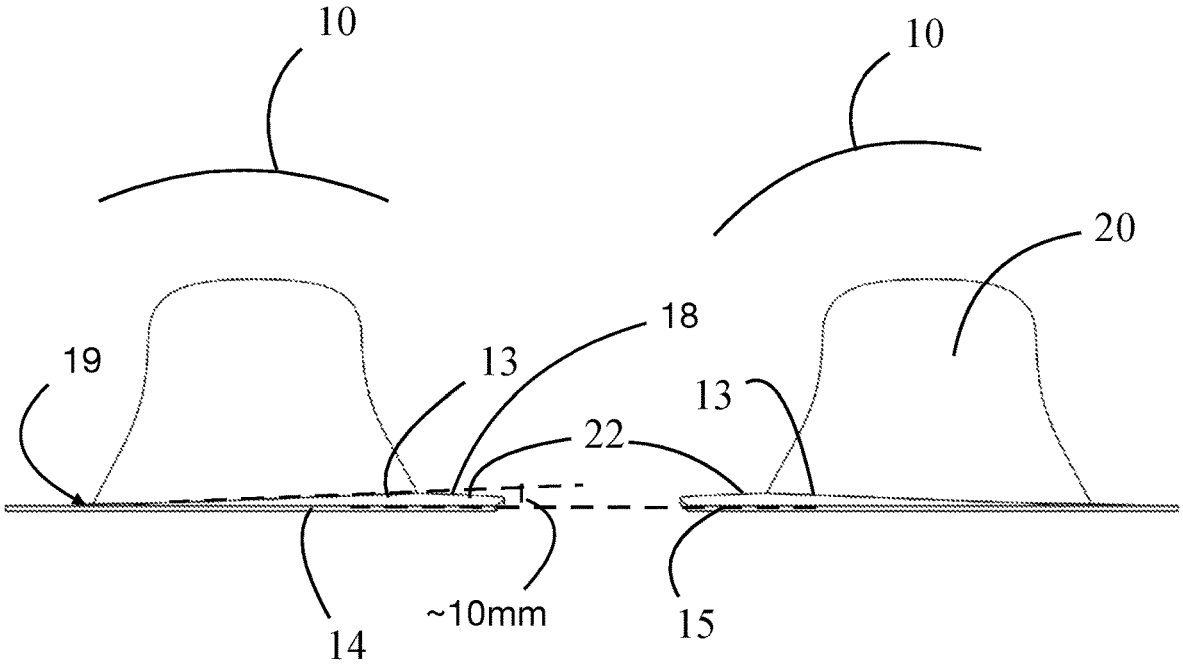
FIG. 4 is a tail elevation view of the fin blade shown in FIG. 1, but shown with the other one in the pair. The lift on the inside edge of the fin blade at the tongue end can be seen, which causes the main blade portion to twist.
Figure 5:
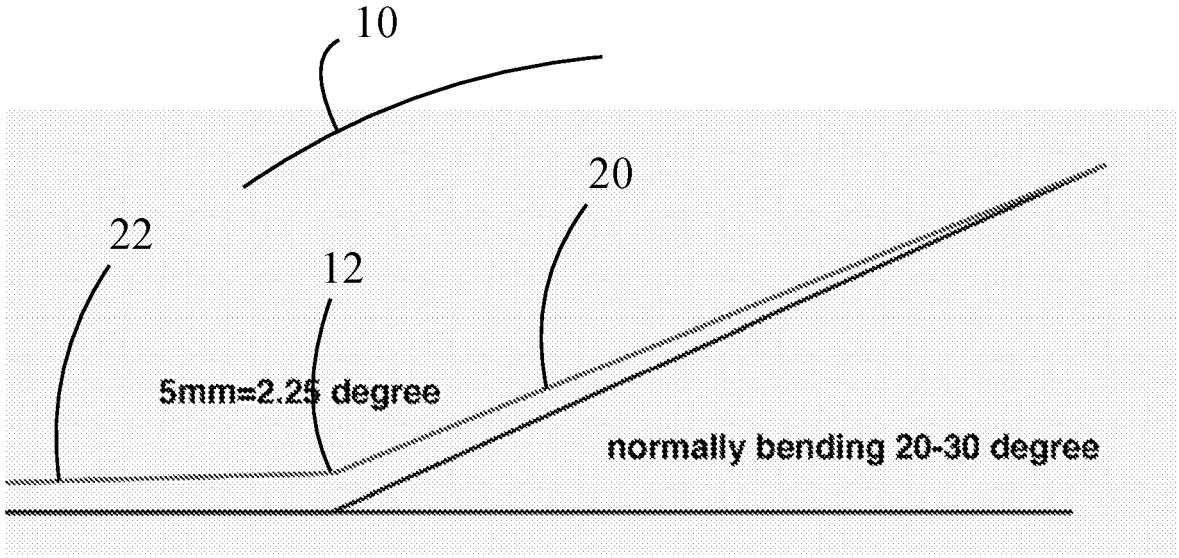
FIG. 5 is a side elevation section view of the proximal end of the blade, showing the comparison between the known and the new embodiments, with one lateral edge adjacent the tongue being higher than the other lateral edge in the new blade, by 5 mm.
Figure 6:
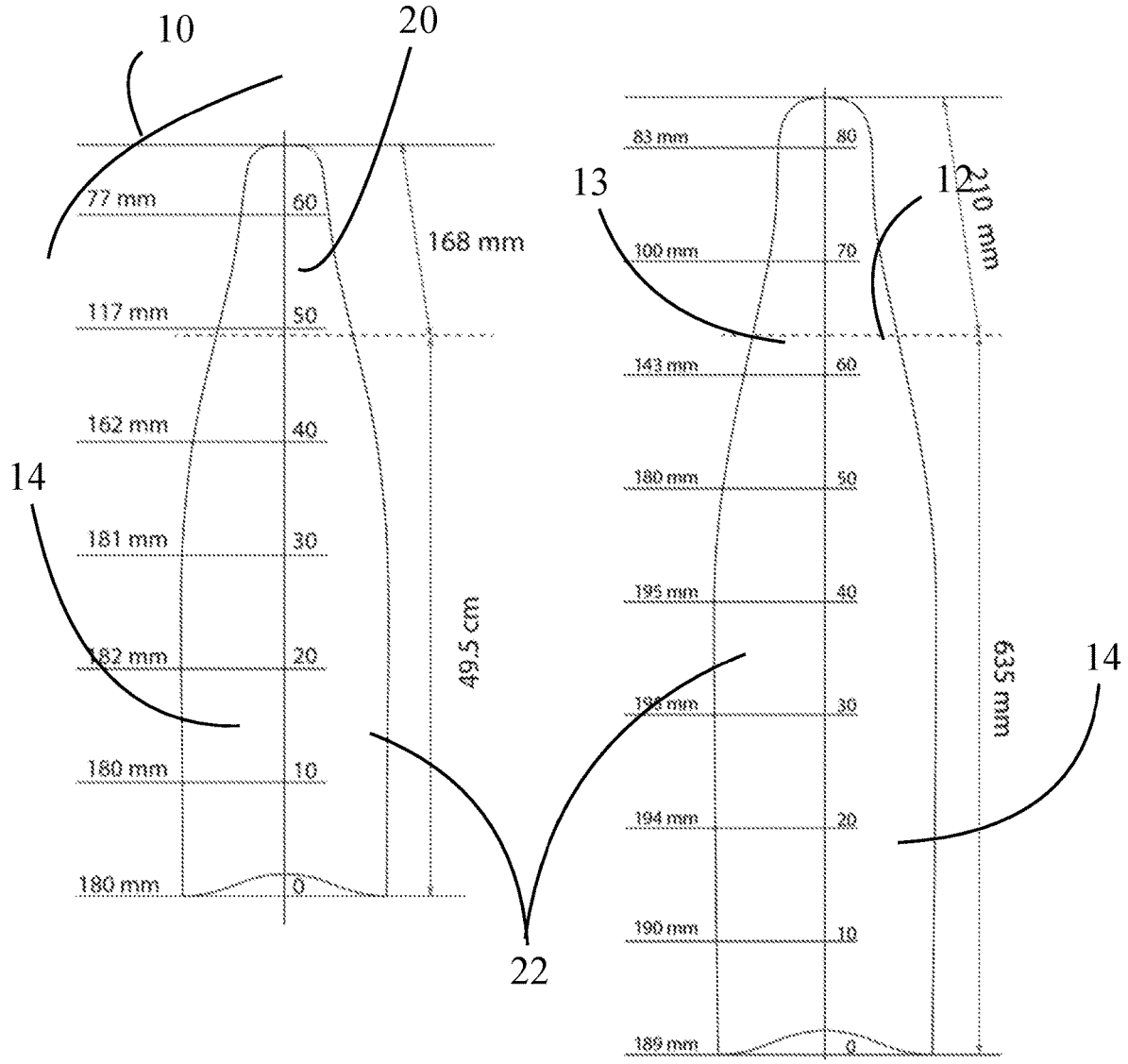
FIG. 6 a plan view of two different sizes of the two blades of an embodiment of the present technology.
Figure 13:
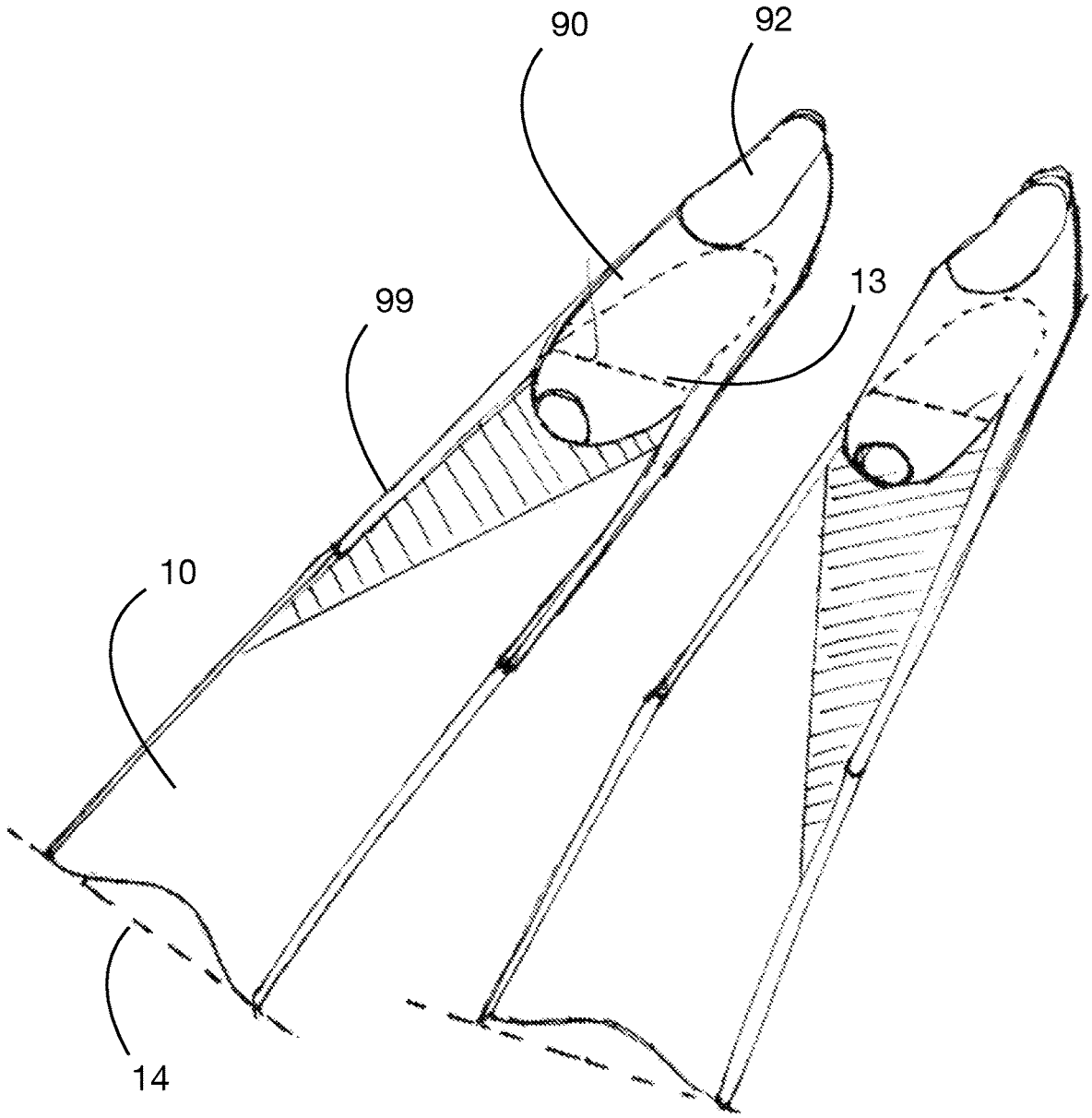
FIG. 13 is a perspective view of an assembled pair of fins wherein the foot pockets and frames from FIG. 10 are joined to the fin blades from the other Figures.

Referring to the drawings there is shown an embodiment of free diving fin blade generally indicated at 10. The fin blade 10 is angled and/or twisted along at least a portion of its length about a yaw, or longitudinal, axis as shown in at least FIG. 1. The fin blade 10 is configured to fit into a foot pocket 90 of a fin frame so as to form a complete fin assembly shown in FIG. 13. The fin blade 10 may be glued or otherwise fastened into place in rails 99 of a foot pocket 90, or the fin blade 10 may be molded to form a unified fin which cannot be disassembled.

The fin blade 10 includes a tongue 20 integral with or connected to a main blade portion 22. The tongue 20 when the fin blade 10 is assembled into the foot pocket 90, fits under the foot receiver 92.

Yaw Angle—Twisted Main Blade

It can be seen in the Figures that the free diving fin blade 10 has a cross section at the proximal end 12 which is disposed at an angle relative to the cross section at the distal end 14. To make this more clear, it can be seen that a lateral line 13 which extends across the fin blade 10 at the proximal end 12, is disposed at an angle relative to a lateral line 15 extending across the fin blade 10 at the distal end 14. Again, in a hope to make it even more clear, it should be understood that the lateral line 13, 14 may be disposed anywhere along the blade, and as long as the two lateral lines 13,14 are spaced some distance apart, the twist may occur anywhere along the blade 10, for any suitable length.

The main blade portion 22 may be twisted such that the two lateral lines 13 and 14 are angled relative to each other by between 0.5 and 45 degrees. Most usefully it seems that the twist angle is about 2.25 degrees as shown in the Figures, but depending on the ergonomics of the user, the twist angle may be between 2 and 20 degrees, or between 10 and 20 degrees, or between 15 and 20 degrees, or by between 25 and 30 degrees, or between 0.5 and 1 degrees, or between 1 and 2 degrees, or between 2 and 3 degrees. The twist angle may be 2, 2.25, 2.25, 2.75, 3, 3.5, 4, 4.5, 5, 6, 7, 8, 9, 10, 11, 12, 13, 14, 15, 16, 17, 18, 19 or 20 degrees depending on the ergonomics of the intended user.

It can be seen that the 2.25 degree twist shown in the Figures results in one end 18 of the lateral line 13 at the end adjacent the tongue 20 (or proximal end) is elevated relative to the other end 19 of the lateral line 13 by about 5 mm. This does depend on the width of the main blade portion 22. In other embodiments, although not shown, it is to be understood that good performance and comfort can be obtained when the elevation is between 1 and 50 mm, or between 2 and 35 mm, or between 5 and 10 mm. The elevation of the end 18 of the lateral line may therefore be 3, 4, 5, 6, 7, 8, 9, 10, 11, 12, 13, 14, 15, 16, 17, 18, 19, 20, 21, 22, 23, 24, 25, 26, 27, 28, 29 or 30 mm to provide good comfort and performance depending on the ergonomics of the intended user.

It is believed that at least the abovementioned twist angle, and/or the features described below, of the free diving fin blade 10 of the embodiment shown provides a fin which is more closely aligned with the ergonomic complexities of the human body, such that during finning (the diving term for kicking along, up or down, with the legs while wearing fins on the feet) the blade provides more comfort and/or greater propulsion than known fins.

Construction of Fin Blade

Figure 7:
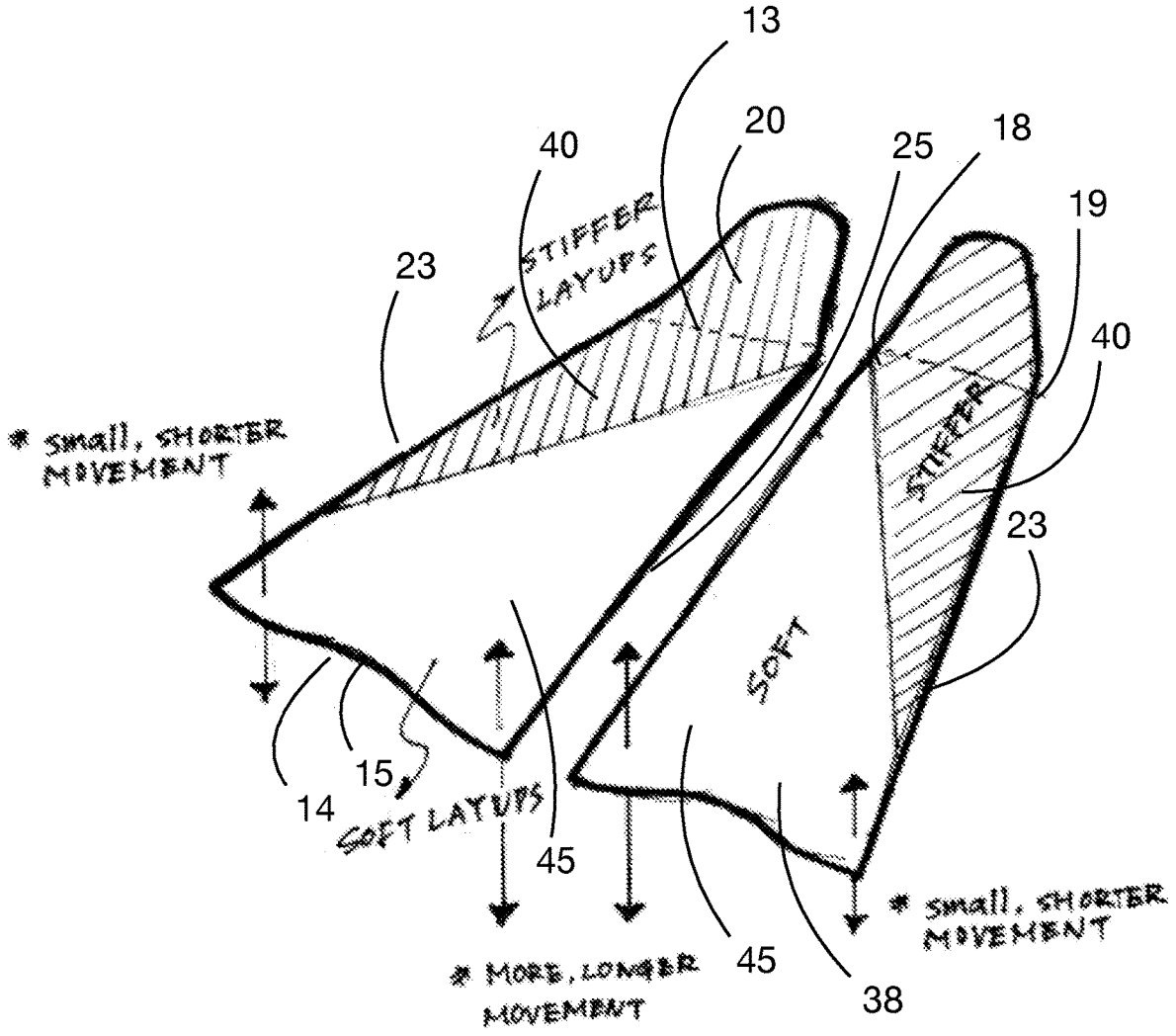
FIG. 7 is an isometric view from underneath of a pair of fin blades in accordance with an embodiment of the present disclosure, showing construction of strengthened zones for increased stiffness, and weaker zones for increased catch.
Figure 8:
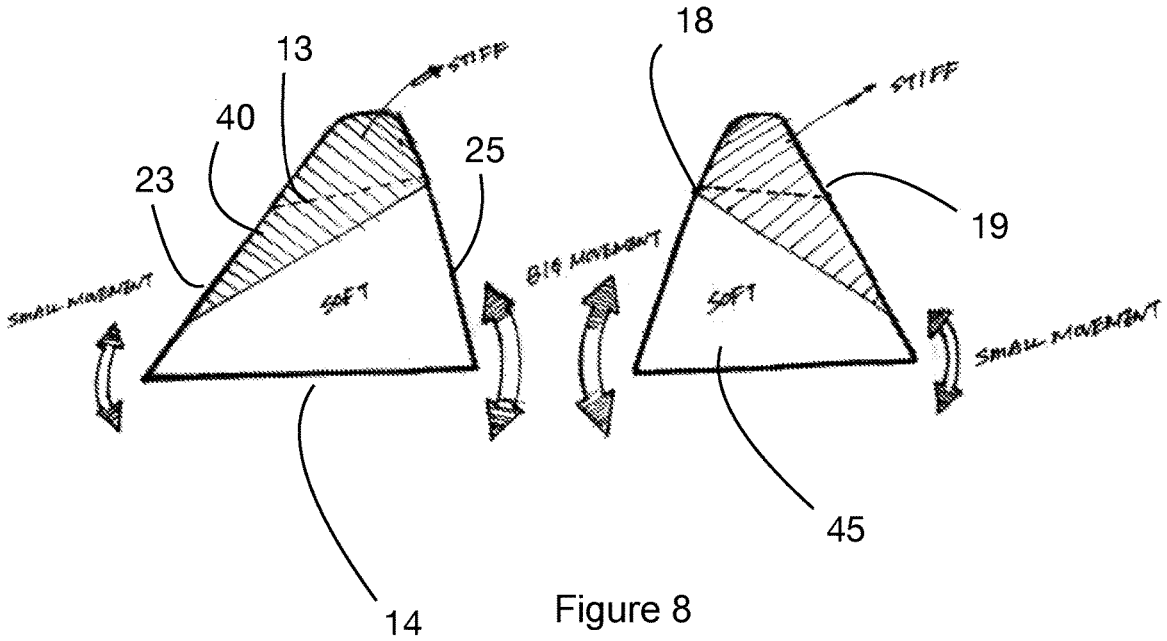
FIG. 8 is a perspective view from the tail end of two fin blades shown in FIG. 7, showing the strengthened (outer) and relatively weakened zones (inner)
Figure 9:
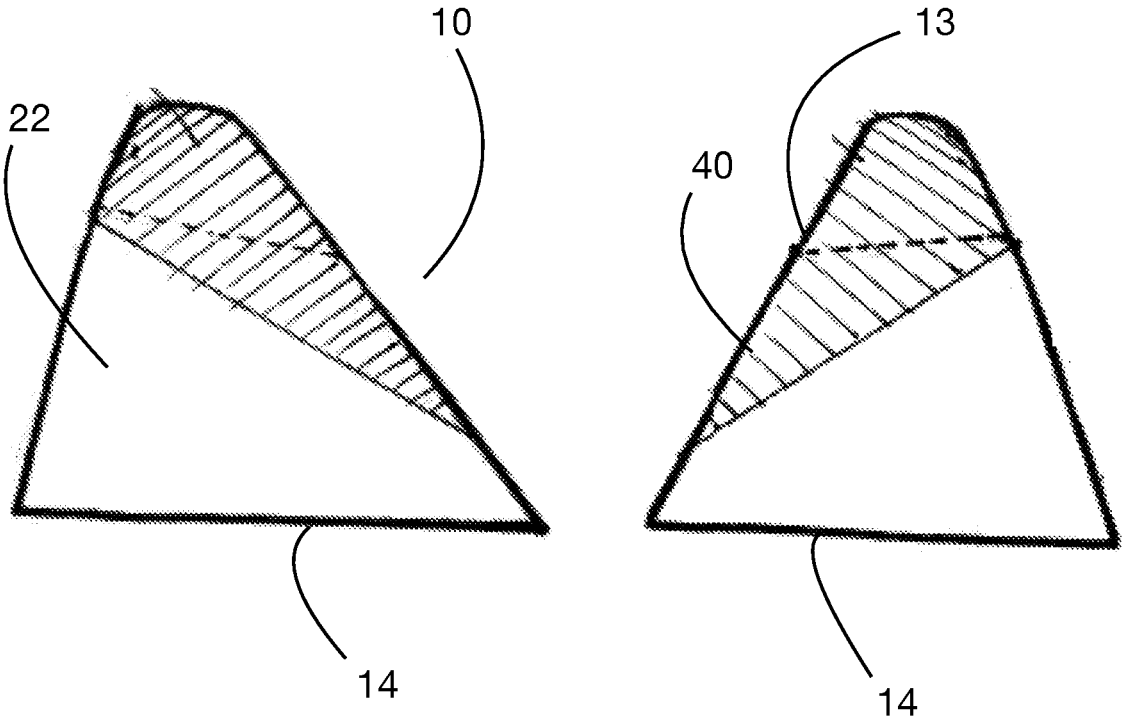
FIG. 9 is a perspective view from the tail end of two fin blades, similar to those shown in FIGS. 7 and 8, but which have been flipped, so that the strengthened zones are proximal the inner edges.
Figure 10:
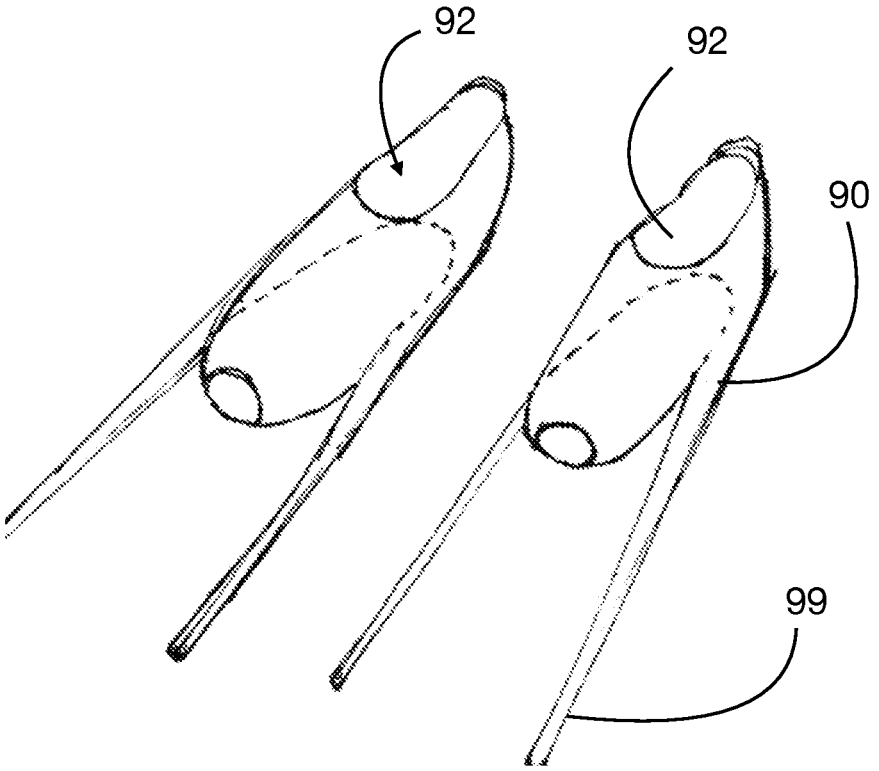
FIG. 10 is a perspective view of a pair of foot pockets with frames for receiving the fin blades.
Figure 11:
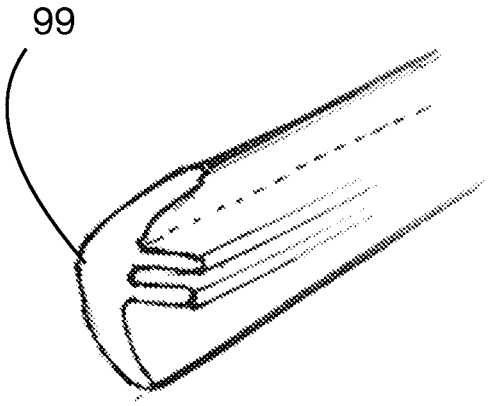
FIG. 11 is a detail of a fin frame rail which shows the profiled section for receiving the fin blades.
Figure 12:
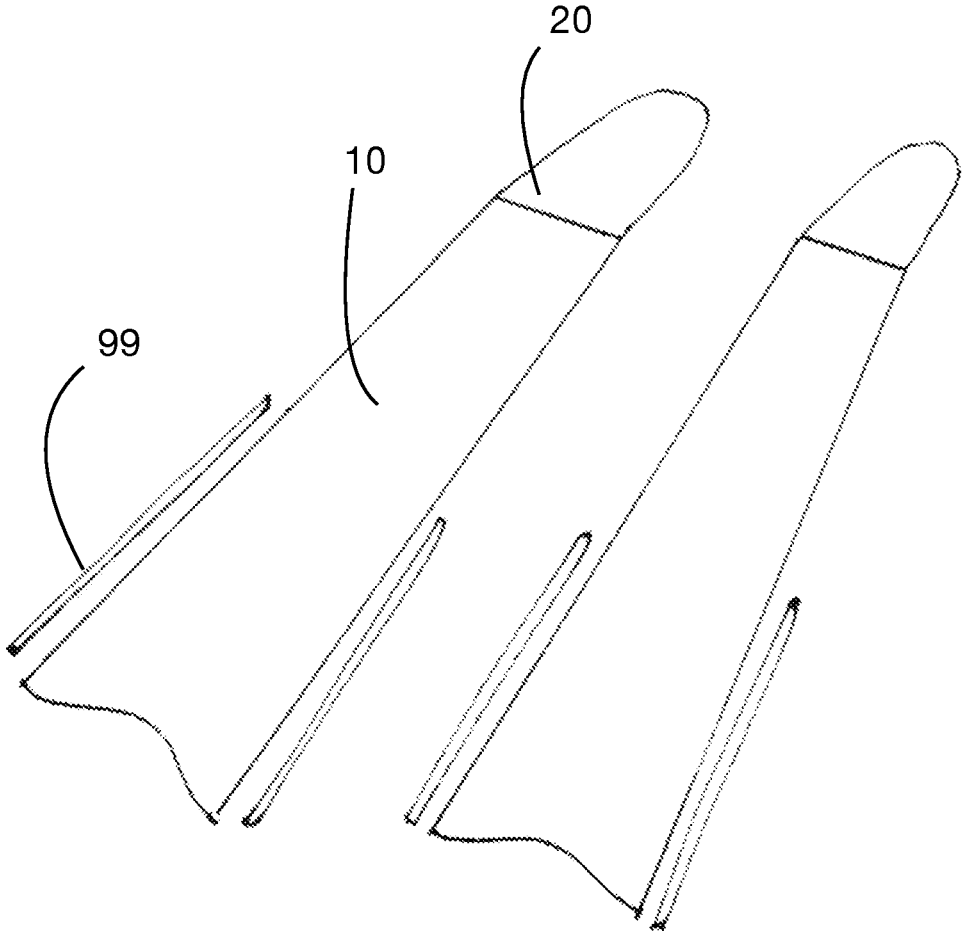
FIG. 12 is a partial exploded view of a pair of fin blades, adjacent the fin frame rails.

Turning to FIGS. 7 and 8, an example construction of fin blades 10 is shown.

The blades are constructed from carbon fiber, but they may equally well be constructed from polymer or fiberglass or other suitable material.

The fin blades 10 in the embodiment shown are constructed from carbon fiber, and includes a carbon fiber matrix 38 with a reinforced zone 40 and a catch zone 45, which is more flexible. The reinforced zone 40 is disposed in a region generally encompassing the tongue 20, and extending into an outer zone of the fin blade proximal the outer toes, and along at least a portion of an outer edge 23 of each fin blade 10.

Generally speaking, an inner edge 25 is free from reinforcement, and includes only the matrix 38, which is a blade of flexible carbon fiber mat with suitable resin. In this way, it is considered that the inner edge 25 should be more flexible than the outer edge 23 so that the inner region at the tail or distal end 14 functions as a catch zone. In this manner the whole blade is believed to operate more efficiently than known blades where the whole blade flexes and catches evenly across the whole width of the blade.

In some constructions the reinforced zone 40 includes a layup of additional 200 g balance strength carbon fiber matting to provide the reduced flex in the outer zone along the outer edge 23 and proximal where the outer toes would be in the fin assembly at 19, when fitted to a user. This construction, stiffer on the outer, proximal end (towards 19 and 23), contributes to a more efficient catch and propulsion over known fin blades. In combination with the twisted angle, there is believed to be increased ergonomic matching, comfort and power when finning.

The reinforced zone 40 on the main blade portion 22 is confined substantially in the embodiment shown to a triangular area bounded by a line from 18 to an intermediate point 27 along the outer edge 23 of the main blade portion 22. The intermediate point 27 may be any suitable distance from the distal end 14, say 10 mm, 20 mm, 30 mm, 40 mm, 50 mm, 60 mm, 70 mm, 80 mm, 90 mm, 100 mm, 110 mm, 120 mm, 130 mm, 140 mm, 150 mm, 160 mm, 170 mm, 180 mm, 190 mm, 200 mm, 210 mm, 230 mm, 240 mm, 250 mm, 260 mm, 270 mm, 280 mm, 290 mm or 300 mm.

Roll Angle—Tongue/Blade

It can be seen from the drawings that the tongue 20 is also angled (about a roll axis or substantially lateral line, say, line 13 in the drawings) relative to the main blade portion 22 for increased comfort and efficiency when finning. The main blade portion 22 is angled downward relative to the tongue 20 to facilitate finning on the surface, and for ergonomic finning when ascending or descending.

The main blade portion 22 may be angled relative to the tongue upwardly or downwardly by between 1 and 45 degrees. While the Figures show about 30 degrees is probably optimal, the roll angle may be 2, 5, 6, 7, 8, 9, 10, 13, 15, 17, 20, 22, 25, 27, 30, 35, 40 or 45 degrees, depending on the technique of the proposed user.

Fin Assembly

The tongue 20 and main blade portion 22 are substantially planar in shape, for ease of fitment into a fin pocket 90.

The main blade portion 22 is configured to be inserted into frame rails 99 which have some height above the planar surface of the main blade portion 22, to inhibit vortices forming, or simply to channel water along the blade more effectively for greater efficiency of finning. The rails 99 also facilitate increased stiffness of the main blade portion.

Further Clarifications

Modifications and improvements to the disclosure will be readily apparent to those skilled in the art. Such modifications and improvements are intended to be within the scope of this disclosure.

Advantages

Advantageously, embodiments of the apparatus provide improved matching of the fin to suit the ergonomic mechanics of selected divers for greater efficiency of finning.

The triangle shape of the reinforced zone is one way of naturally providing a gradient of stiffness from relatively strong at the proximal end line 13 to less strength at the distal end line 14. It is believed that a torsion force is provided by the arrangement from the proximal end line 13 to the fin tip line 14 to let the soft part catch more water.

The fin blade pair can be arranged in the fin pocket 90 so that the reinforced area is on the outer edge, and this suits a small kick, allowing a user to kick for longer time at increased efficiency. The swing of the body from left to right is bigger, so the fin's functional surfaces also bigger, then it's more efficient.

When the blade pair is arranged in the fin pocket 90 so that the reinforced area is disposed on the inner edge, this is suitable for a more powerful kick. The swing from left to right on the body during a finning stroke, can be lower, which lets the user place more focus on their kick to push the performance. This also mimics mono fin training but provides more flexibility of movement than monofin training, freeing up the legs and reduces the claustrophobia and uncertainty associated with monofin training.

The invention claimed is:

1. A fin blade suitable for free diving, comprising:

a tongue for connecting a main blade portion to a foot pocket, wherein the main blade portion is planar in shape and is angled downwardly relative to the tongue between 1 and 45 degrees, wherein a proximal lateral line extends laterally at a lateral joint between the tongue and the main blade portion, the proximal lateral line adjacent a proximal end of the fin blade is disposed at an angle relative to a lateral line extending across the fin blade at a distal end at a portion spaced from a proximal end of the fin blade, the proximal lateral line at the proximal end of the fin blade is elevated from one side to another side, and the proximal lateral line at the proximal end is elevated from the one side to the other side between 1 and 50 mm.

2. The fin blade in accordance with claim 1, wherein the main blade portion comprises rails that inhibit vortices forming, or that channel water along the fin blade.

3. The fin blade in accordance with claim 1, wherein lateral lines extend from rail to rail such that substantially a whole cross-section of the main blade portion is twisted at one end relative to an other end.

4. The fin blade in accordance with claim 1, wherein an elevation of the proximal lateral line at the proximal end causes a relative angle of lateral lines at the distal end to be between about 2 and 45 degrees.

5. The fin blade in accordance with claim 4, wherein the relative angle is about 2.25 to 6 degrees.

6. The fin blade in accordance with claim 1, wherein the main blade portion comprises a flexible matrix, and a reinforced zone disposed on the flexible matrix in a region proximal to the foot pocket and extending along at least a portion of one edge, extending towards the distal end.

7. The fin blade in accordance with claim 6, wherein the reinforced zone is disposed in a substantially triangular region at a proximal end near the foot pocket, bounded by a line from one end at one edge of a proximal region to an intermediate point along an other edge of the main blade portion.

8. The fin blade in accordance with claim 6, further comprising a flexible catch zone adjacent the reinforced zone on the distal end, which is flexible.

9. The fin blade in accordance with claim 8, wherein the flexible catch zone is disposed in an inner edge region or an outer edge region of the distal end when in a pair.

10. The fin blade in accordance with claim 6, wherein the reinforced zone comprises a layup of about an additional 200 g balance strength carbon fiber matting to provide reduced flex in the reinforced zone.

11. A fin assembly for free diving which comprises the fin blade in accordance with claim 1, wherein the fin blade is fastened to or integral with the foot pocket.

* * * * *